US006119622A

United States Patent [19]

Banerjea

[11] Patent Number: 6,119,622

[45] **Date of Patent: *Sep. 19, 2000**

[54] INDICATOR FOR DELIVERY ITEM COLLECTION RECEPTACLE

[76] Inventor: Robin R. Banerjea, 14766 Atwater St., Sterling Heights, Mich. 48313

[ * ] Notice: This patent issued on a continued prosecution application filed under 37 CFR 1.53(d), and is subject to the twenty year patent term provisions of 35 U.S.C. 154(a)(2).

[21] Appl. No.: 08/403,384

[22] Filed: Mar. 14, 1995

[51] Int. Cl.[7] ..... B65D 91/00

[52] U.S. Cl. ..... 116/202; 232/35; 340/569

[58] Field of Search ..... 116/202; 232/33–37; 340/569

[56] References Cited

U.S. PATENT DOCUMENTS

| | | | |
|---|---|---|---|
| 637,416 | 11/1899 | Rees | 232/37 |
| 786,225 | 3/1905 | Lister | 232/37 |
| 2,835,887 | 5/1958 | Seeley et al. | 340/569 |
| 3,965,465 | 6/1976 | Alexander | 340/527 |
| 4,154,393 | 5/1979 | Darvishian | 340/569 |
| 4,372,482 | 2/1983 | Clerigues | 232/36 |
| 4,437,607 | 3/1984 | Negosta | 232/34 |
| 5,040,723 | 8/1991 | Kelley, Sr. | 232/34 |
| 5,130,695 | 7/1992 | Scarbrough et al. | 340/527 |
| 5,440,294 | 8/1995 | Mercier et al. | 232/35 |

*Primary Examiner*—Andrew Hirshfeld
*Attorney, Agent, or Firm*—John R. Benefiel

[57] ABSTRACT

A pickup indicator arrangement for a collection receptacle for deposit of items for delivery is described in which an on-off light is turned on by operation of a switch when the pickup is made. A timer turns the display off after a predetermined delay to ready the display for the next pickup.

9 Claims, 1 Drawing Sheet

INDICATOR FOR DELIVERY ITEM COLLECTION RECEPTACLE

BACKGROUND OF THE INVENTION

This invention concerns delivery item collection receptacles such as U.S. mail deposit boxes and courier service collection as provided by the following commercial carrier services: FEDERAL EXPRESS, boxes, i.e., FEDERAL EXPRESS, DHL, UPS, AIRBORNE, etc.

A recurring problem involves the uncertainty as to whether a scheduled pickup has occurred when a deposit is attempted around the time of the pickup. If the pickup has already occurred, the delivery of the item may be seriously delayed, perhaps until the next day. If the pickup has been delayed past the posted pickup, the benefit of this added period for making deposits is lost since a deposit cannot be chanced after the posted time.

There has heretofore been proposed a solution to this problem ii in the context of mail collection boxes. See U.S. Pat. Nos. 900,756; 738,849; and 683,598 for examples of door and manually operated displays. This approach still suffers from the disadvantage that the person attempting a deposit must go to the receptacle and closely examine the pickup display to determine if the scheduled pickup has occurred. The typical modern-day situation involves driving to the location where the collection box is located, parking the car, and walking to the box to make the deposit. Obviously, it is very inconvenient and time consuming to be obliged to do this if in fact the pickup has already occurred.

Furthermore, the person attempting a deposit is typically urgently looking for a pickup location where he or she can be sure a pickup will occur as scheduled, and any delay caused by such a time-consuming investigation is a serious impediment to getting the item delivered on time.

The present-day business circumstances often involve critical importance of prompt delivery of legal documents, business proposals submitted under a deadline, etc.

There have also been numerous proposed devices for providing a remote indication to a postal patron that mail has been left in an individual mailbox. See U.S. Pat. Nos. 5,040,723; 5,255,843; and 4,964,565 for examples of such indicators.

It is an object of the present invention to provide an indicator for collection receptacles which solves the above-described difficulties and which also provides other benefits, particularly for those companies involved in commercial delivery services, and for persons attempting last minute deposits.

SUMMARY OF THE INVENTION

This and other objects of the present invention, which will become apparent upon a reading of the following specification and claims, are achieved by providing an indicator arrangement, including an on-off display mounted atop the receptacle box which is readily viewable from a substantial distance. The display is turned on by means which are inaccessible from the exterior of the receptacle, so that only the person authorized to open the receptacle and pick up the deposited items can activate the indicator arrangement.

The display is turned on after each pickup, either manually or automatically by opening of the door allowing removal of deposited items. A timer is also activated at the same time which causes the display to be turned off after a predetermined substantial delay period so as to be automatically reset in preparation for the next pickup.

The display can be comprised of an electric light, and may be illuminated in different modes corresponding to both pre-pickup and post-pickup conditions.

The illumination of the display can serve to make the collection receptacle more conspicuous to passersby, both as a convenience in locating the receptacle from a distance, particularly at night and/or under adverse weather conditions, and also to effect a promotional benefit for the particular delivery company so equipping its receptacles.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
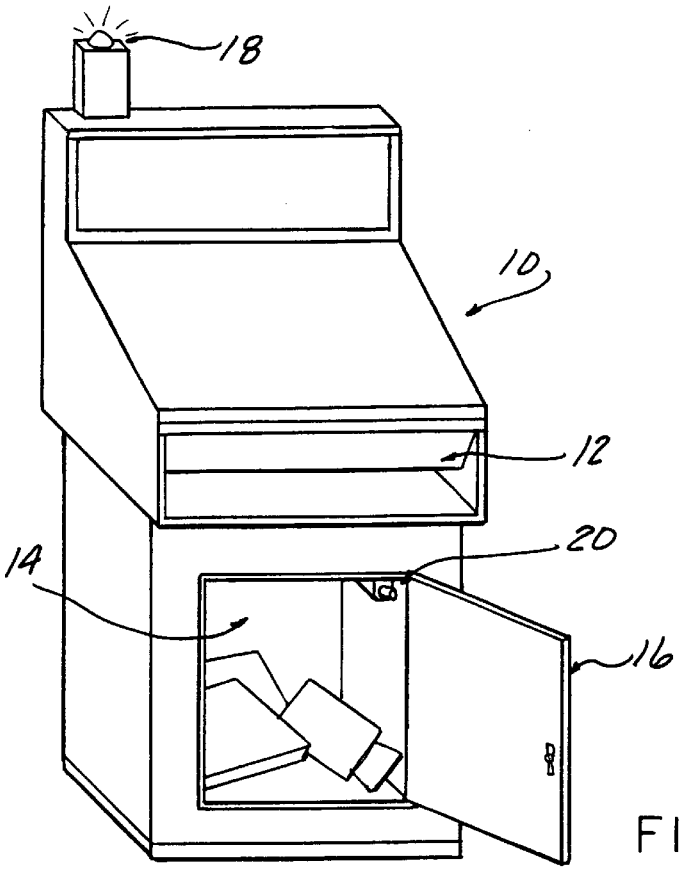
FIG. 1 is a perspective view of a collection receptacle equipped with an indicator according to the present invention.
Figure 2:
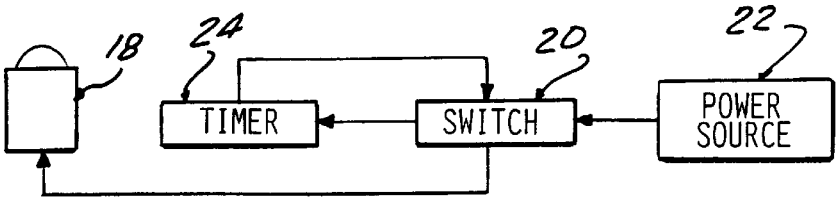
FIG. 2 is a block diagram of the indicator circuitry associated with the indicator shown in FIG. 1.

Referring to the drawings, FIG. 1 shows a typical collection receptacle 10 of a commercial delivery company. A pickup schedule 11 is posted on the receptacle 10. Items are deposited into a door slot 12, passing into a secured space 14 accessible only through a door 16, normally locked so as to be able to be opened only by authorized personnel.

According to the concept of the present invention, an indicator arrangement includes an on-off display comprised of an electric light 18 mounted so as to be viewable from any angle, and bright enough to be seen from distances remote from the receptacle 10. The display light 18 is turned on by a switch 20 mounted with the space 14 so as to be accessible only to authorized personnel able to open the door 16. The switch 20 can either be manually tripped after opening the door, or automatically by the opening of the door itself by proper positioning of a switching button.

The light 18 can be powered either by permanent wiring to locally available power, or by a battery power source 22.

After energizing, the indicator light 18 remains turned on for only a limited period due to the operation of a timer 24 also activated by operation of the switch 20, which resets the switch 20 after a predetermined substantial period of delay. For example, the timer causes interruption of the circuit at midnight, when the light is initially activated at a 7:00 p.m. pickup, the period of delay thus being several hours.

Thus, after the elapsed time, the indicator lamp 18 is ready for reactivation as the pickup time again approaches.

Figure 3:
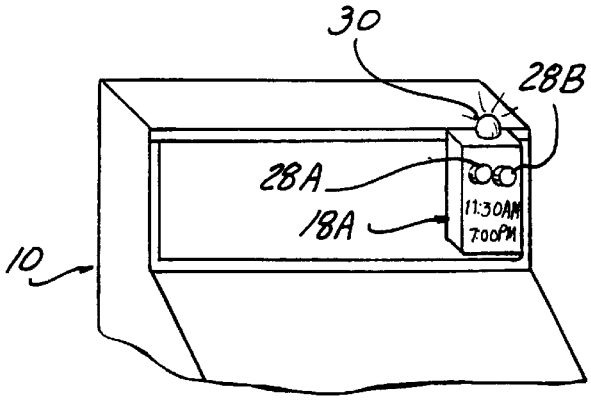
FIG. 3 is a fragmentary perspective view of a portion of a collection box equipped with an alternate form of the indicator according to the present invention.

The display 18A of FIG. 3 may also include a pair of adjacent lights 28A, 28B, one or the other of which is continuously lit at all times, one prior to pickup, one after pickup, preferably of different colors, i.e., green and red, respectively. A red light 30 atop the receptacle viewable from all directions can also be provided. Lights 28A, 28B are energized by a double pole switch operated by the timer means.

The eye-catching effect of illuminated electric lights also makes the collection receptacles more conspicuous to draw attention to their location from a distance, at night, and/or in adverse weather, as well as to promote the particular company. A particular light color associated with the company owning the receptacle can be selected to further enhance the promotional benefit of such a display.

While an electrical light display has been described and is preferred since it has superior visibility at a distance, a mechanical on-off display may also be provided.

I claim:

1. An indicator arrangement attached to a collection receptacle having a closed space accessible only through a normally locked door for retrieving items deposited for delivery through a separate deposit slot, said collection receptacle having a pickup schedule posted thereon, said indicator arrangement comprising:

a selectively activatable on-off light display mounted on said receptacle, said light display readily viewable at a remote distance from said collection receptacle;

on-off switching means operable to be switched on or off, said on-off switching means mounted within said closed space to be able to be switched on to enable activation of said light display when a pickup from said collection receptacle is made through said door; and, timer means initiated when said switching means is switched on to activate said light display and causing said on-off switching means to be switched off and said light display to be deactivated after a predetermined substantial period of delay on the order of several hours after said switching means is switched on to ready said on-off switching means to again be switched on when another pickup is made.

2. The indicator arrangement according to claim 1 wherein said light display comprises an electric light mounted atop said receptacle to be viewable from all angles, said electric light being activated by said on-off switching means mounted within said closed space and deactivated by said timer means causing said switching means to be subsequently switched off.

3. The indicator arrangement according to claim 1 wherein said light display comprises an electric light mounted atop said receptacle to be viewable from all angles, said electric light being activated by said on-off switching means mounted within said closed space and deactivated by said timer means causing said switching means to be subsequently switched off, and further including a pair of adjacent electric lights, one of which is activated by said on-off switching means mounted within said closed space and deactivated by said timer means causing said switching means to be switched off, the other of said pair of adjacent electric lights deactivated when said one light is activated and activated when said one light is deactivated, said pair of lights being of different color from each other.

4. The indicator arrangement according to claim 3 wherein said timer means comprises an electric timer energized by switching on of said on-off switching means.

5. The indicator arrangement according to claim 1 further including a second light display of a different color, said second light display activated whenever said first-mentioned display is inactivated by said timer means.

6. A method for indicating that a scheduled pickup at a collection receptacle for items deposited for a pickup according to a schedule posted on the receptacle has been made said collection receptacle having a closed space accessible only through a normally locked door for retrieving items deposited for delivery through a separate deposit slot, said method, comprising the steps of:

activating a light display readily viewable remotely from said receptacle by operating switching means having an on or off condition so that said on-off switching means is switched on to turn on said light display when said scheduled pickup has been made through said door; and, automatically switching said on-off switching means to an off condition to turn said light display off after a predetermined substantial period of delay on the order of hours after said switching means is turned on to prepare said display for the next scheduled pickup.

7. The method according to claim 6 wherein said activating step includes the step of manually operating on-off switching means within said closed space within said collection receptacle to turn on said light display, and causing a timer to automatically switch said switching means to turn off said light display after said period of delay on the order of several hours.

8. An indicator arrangement attached to a collection receptacle having a closed space accessible only through a normally locked door for retrieving items deposited for delivery through a separate deposit slot, said collection receptacle having a pickup schedule posted thereon, said indicator arrangement comprising:

a selectively activatable display mounted on said receptacle, said display readily viewable and indicating a pickup of said collection receptacle has been made;

on-off switching means operable to be switched on or off, said on-off switching means mounted within said closed space to be able to be switched on to enable activation of said display when a pickup from said collection receptacle is made through said door; and, timer means initiated when said switching means is switched on to activate said display and causing said on-off switching means to be switched off and said display to be deactivated after a predetermined substantial period of delay on the order of several hours after said switching means is switched on to ready said on-off switching means to again be switched on when another pickup is made.

9. A method for indicating that a scheduled pickup at a collection receptacle for items deposited for a pickup according to a schedule posted on the receptacle has been made, said collection receptacle having a closed space accessible only through a normally locked door for retrieving items deposited for delivery through a separate deposit slot, said method comprising the steps of:

activating a readily viewable display indicating a pickup has been made by operating switching means within said receptacle having an on or off condition so that said on-off switching means is switched on to activate the display when said scheduled pickup has been made through said door and continuing activation of said display after said scheduled pickup has been made and said door closed; and, automatically switching said on-off switching means to an off condition to turn said light display off after a predetermined substantial period of delay on the order of hours after said switching means is turned on to prepare for activation of said display with the next scheduled pickup.

* * * * *

UNITED STATES PATENT AND TRADEMARK OFFICE

CERTIFICATE OF CORRECTION

PATENT NO. : 6,119,622
DATED : September 19, 2000
INVENTOR(S) : Robin R. Banerjea It is certified that error appears in the above-identified patent and that said Letters Patent is hereby corrected as shown below:

Column 4,
Line 59, delete “light” and insert therefor -- viewable --.

Signed and Sealed this

Eighteenth Day of March, 2003

JAMES E. ROGAN
*Director of the United States Patent and Trademark Office*